United States Patent [19]

Feller et al.

[11] Patent Number: 4,646,489

[45] Date of Patent: Mar. 3, 1987

[54] PLASTIC FENCE POST BOTTOM REPAIR DEVICE

[76] Inventors: Duane D. Feller; Richard P. Shaug, P.O. Box 343, both of, Greenfield, Calif. 93927

[21] Appl. No.: 827,002

[22] Filed: Feb. 7, 1986

[51] Int. Cl.[4] ..... E02D 5/74

[52] U.S. Cl. ..... 52/165; 256/DIG. 5

[58] Field of Search ..... 52/165; 403/405.1; 256/DIG. 5, DIG. 4

[56] References Cited

U.S. PATENT DOCUMENTS 398,078 2/1889 Peterson ..... 52/165

747,435 12/1903 Jenkins ..... 52/165

1,123,105 12/1914 Crews ..... 52/165

4,474,493 10/1984 Welch ..... 403/405.1 X 4,543,757 10/1985 Cosgrove ..... 52/165 X

*Primary Examiner*—Andrew V. Kundrat

[57] ABSTRACT

This fence post bottom repair device is designed to save old fence posts and also be employed on a new fence post when installed, so as to prevent its rotting in the soil. Primarily, it consists of a hollow square configurated body having a pair of leg portions at the top that are fastened to the sides of the bottom portion of a fence post by suitable fasteners, and a spacer plate is also provided to insures a tight fit of the body to the post when necessary.

1 Claim, 5 Drawing Figures

FIG. 1
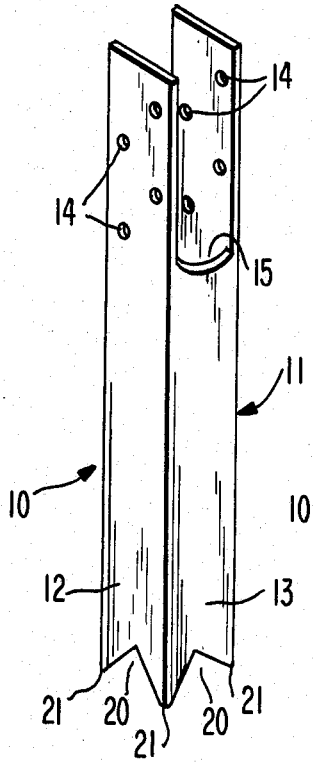
FIG. 2
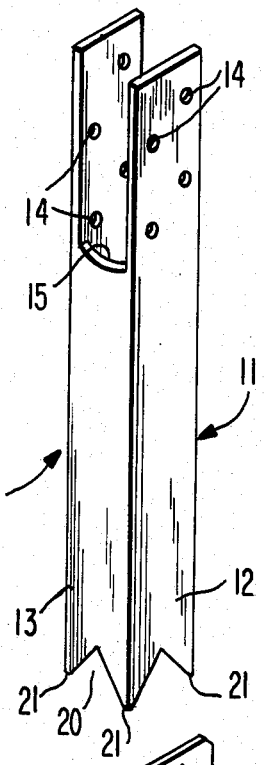
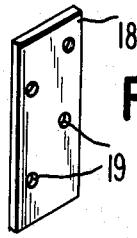
FIG. 3
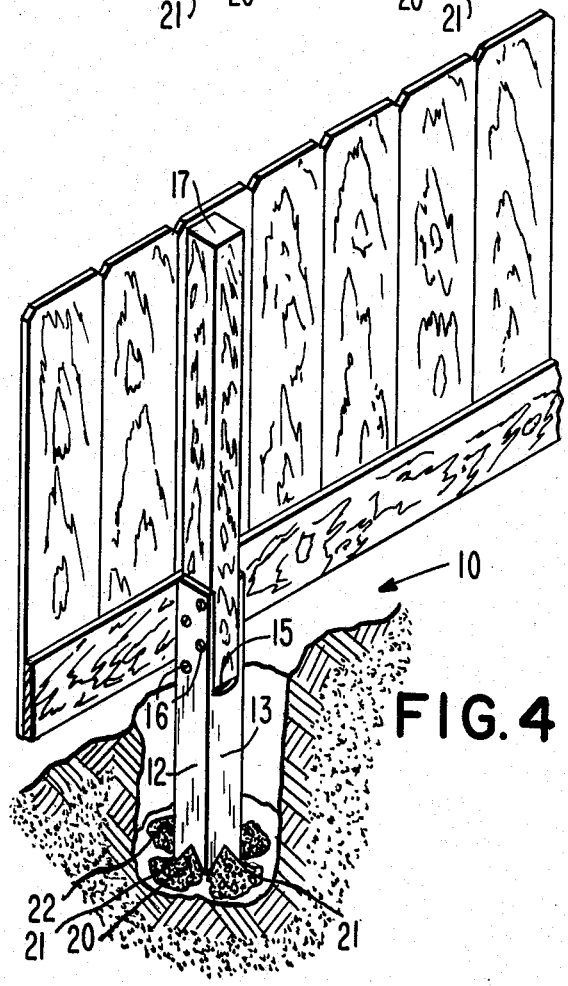
FIG. 4
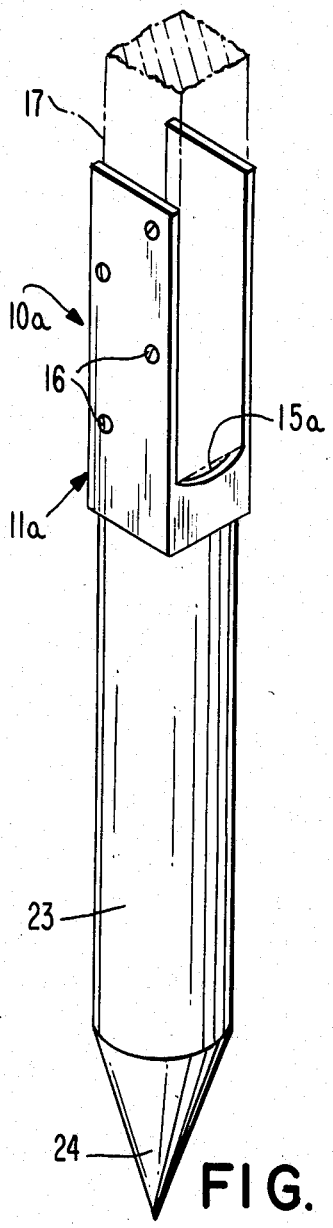
FIG. 5

PLASTIC FENCE POST BOTTOM REPAIR DEVICE

BACKGROUND OF THE INVENTION

1. Field of the Invention

This invention relates to repair devices, and more particularly, to a plastic fence post bottom repair device.

2. Description of Prior Art

Fence post bottoms are known to rot at the bottom and usually have to be discarded. The bottom repair device in accordance with the present invention, is so designed, as to effectively repair the bottom's of old fence posts, and may be used when installing new posts as well.

The principal object of this invention is to provide a plastic fence post bottom repair device, which will be unique, in that it will be of such structure as to be employed to fix old fence posts that have rotted at their bottom's, and the device may be employed with new posts when they are installed.

Another object of this invention is to provide a plastic fence post bottom repair device, which will be of such design as to never need replacing, and it may also be filled with concrete if desired.

BRIEF DESCRIPTION OF THE DRAWINGS

FIG. 1 is a perspective view of the present invention;

FIG. 2 is similar to FIG. 1, but illustrates the opposite side thereof;

FIG. 3 a perspective view of a spacer employed with the present invention;

FIG. 4 is a perspective view of a fence employing the invention, and

FIG. 5 is a perspective view of a modified form of the invention.

SUMMARY OF THE INVENTION

This bottom repair device for the bottom of a fence post, comprises a plastic main body that will save two feet of a four by four inch fence post, and it includes an upper end with openings for receiving suitable fasteners to secure it to the bottom of a post, and it may be employed in the installation of new fence posts, thus, preventing them from rotting at the bottom.

DETAILED DESCRIPTION

Accordingly, a repair device 10 is shown to include a main body 11 of hollow and square cross-sectional configuration, fabricated of a suitable plastic material. Main body 11 is provided with flat sides 12 and 13 which are integrally attached, and spaced openings 14 are provided through sides 12 above the transverse cut-out 15, for receiving suitable fasteners 16 that will secure device 10 to a post 17 at its bottom end. A spacer plate 18 is also provided and fabricated of plastic, so as to be used within the upper portion of device 10 when necessary for a better fit of device 10 to post 17. Spaced openings 19 are provided through spacer plate 18 and align with the openings 14 in main body 11, so as to accommodate the fasteners 16, and triangular cut-out openings 20 in the bottom of main body 11, define corner teeth 21. When installed, concrete 22 is poured into main body 11, and it extends from the cut-out openings 20 and forms greater anchoring means for post 17, if desired.

In use, main body 11 is installed on the bottom end of post 17 and the fasteners 16 are placed in the openings 14 thereof and entered into the sides of the post 17, thus, firmly securing device 10 to the bottom of the post 17. When necessary, a spacer plate 18 is used within the top of device 10 to insure proper and firm fitting of main body 11 to the post 17.

Referring now to FIG. 5, a modified device 10*a* includes a shortened main body 11 with a cut-out opening 15*a* similar to that described of main body 11. However, a lower cylindrical base portion 23 is provided and is integrally attached to the bottom of main body ll*a*, and a conical point 24 is provided on the bottom of 23 for entry into the ground.

In use, lO*a* is fastened to post 17 in the same manner, heretofore described of 10, with the exception, that instead of digging a posthole, the user will drive the post into the ground by the employment of the pointed base portion 23.

While various changes may be made in the detail construction, such changes will be within the spirit and scope of the present invention, as defined by the appended claims.

What we now claim is:

1. A fence post bottom repair device, comprising, a main body, a pair of legs defined in the upper end of said main body by a transverse cut-out opening through said main body, and said pair of legs are fastened to a bottom portion of a fence post by suitable fasteners, and a triangular opening is provided in bottom ends of sides of said main body below said post, and define teeth, and each triangular opening receives concrete poured into said main body, that hardens in a post hole and firmly anchors said main body and said post.

* * * * *